US005873019A

United States Patent [19]

Mizuishi

[11] Patent Number: 5,873,019

[45] Date of Patent: Feb. 16, 1999

[54] IMAGE FORMING APPARATUS HAVING ROLLER CLEANING SYSTEM AND METHOD

[75] Inventor: Haruji Mizuishi, Tokyo, Japan

[73] Assignee: Ricoh Company, Ltd., Tokyo, Japan

[21] Appl. No.: 794,401

[22] Filed: Feb. 3, 1997

[30] Foreign Application Priority Data

Feb. 1, 1996 [JP] Japan ..... 8-016806

[51] Int. Cl.[6] ..... G03G 15/14

[52] U.S. Cl. ..... 399/313; 399/176; 399/314; 361/225

[58] Field of Search ..... 399/174–176, 399/313, 314; 361/225

[56] References Cited

U.S. PATENT DOCUMENTS 5,132,738 7/1992 Nakamura et al. .
5,253,022 10/1993 Takeuchi et al. .
5,363,176 11/1994 Ishihara et al. .
5,532,795 7/1996 Tatsumi et al. .
5,557,373 9/1996 Miyashita et al. .
5,557,375 9/1996 Nagayasu et al. .
5,559,590 9/1996 Arai et al. .
5,629,755 5/1997 Ohtsuka ..... 399/176
5,638,158 6/1997 Sanpe et al. ..... 399/115 X
5,678,136 10/1997 Watanabe et al. ..... 399/100

*Primary Examiner*—R. L. Moses
*Attorney, Agent, or Firm*—McDermott, Will & Emery

[57] ABSTRACT

An image forming apparatus of a type having a photoconductive drum surrounded by an exposure station, a toner dispenser, an image transfer roller, a pre-discharging lamp and a contact charging roller incorporates a novel apparatus and method for cleaning the transfer and charging rollers of toner and other contamination. The transfer roller first is cleaned by applying to it an electric bias of alternating polarity to repel toner to the photoconductive element. Charge induced on the photoconductive drum by the toner is neutralized by the contact charging roller, and thereafter, a cleaning element, such as a sponge, is moved into contact with the charging roller for cleaning it of toner. The transfer roller may be separated from the photoconductive drum during image exposure or in response to an exposure synchronization signal, to reduced image distortion caused by mechanical vibration of the drum.

34 Claims, 14 Drawing Sheets

IMAGE FORMING APPARATUS HAVING ROLLER CLEANING SYSTEM AND METHOD

TECHNICAL FIELD

The invention relates to image forming apparatus, such as is found in photocopiers, facsimile machines, printers and the like, and more particularly to apparatus and methodology for cleaning toner bearing components associated therewith.

BACKGROUND ART

Conventional electrophotographic apparatus, such as copiers, printers, facsimile machines, etc., comprise an imaging surface, such as a photoconductive element, normally in the form of a drum or belt. Arranged in timed sequence around the drum are a plurality of processing stations for performing various functions. These processing stations may comprise apparatus for charging the imaging surface, electrostatically forming a latent image on the imaging surface, developing the latent electrostatic image with a developer commonly referred to as a toner, transferring the developed image from the imaging surface to a substrate such as a paper sheet, typically by means of a transfer roller, feeding paper to the transferring station, cleaning the imaging surface, i.e., removing residual toner on the imaging surface, and fixing the transferred developed image on the sheet.

A typical reproduction operation comprises charging the surface of the drum and exposing the charged surface to a light pattern of an original image to be reproduced thereby selectively discharging the imaging surface in accordance with the original image. The resulting pattern of charged and discharged areas on the surface of the photoconductive drum forms an electrostatic charge pattern or electrostatic latent image conforming to the original image.

The latent electrostatic image is developed by contacting it with finely divided toner held by electrostatic force on the imaging surface. The toner image is transferred to the sheet fed by a registration roller toward the drum in synchronization with drum rotation. As the leading edge of the sheet abuts the drum, electrostatic forces adhere the two together, and the transferring station applies toner image from the photoconductive drum to the paper. Thereafter, the toner image is fixed to form a permanent record.

Subsequent to development, and after transfer of the developed image to the paper, some toner inevitably remains on the surface of the photoconductive drum, held thereto by electrostatic and/or VANderWals force. Additionally, other contaminants, such as paper fibers, toner additives, Kaolins and various other forms of debris, have a tendency to be attracted to the charge retentive surface. This residual toner has a tendency to contaminate the backside of a sheet of paper whose front surface is to receive the developed toner image, despite conventional roller and drum cleaning techniques.

Referring to FIGS. 11*a*–11*d*, depicted schematically is an image forming apparatus comprising a photoconductive drum 1 that rotates in direction A such that the surface of the drum successively traverses contact charging roller 2, developing roller 4, transfer roller 5, cleaning blade 7 and pre-discharging lamp 8. The transfer roller 5, which fixes the toner image to a sheet fed to the drum 1 between developing roller 4 and transfer roller 5, is generally formed of a conductive Styrofoam having a porous surface. Toner remaining on the surface of drum 1 from developing roller

4 tends to deposit onto the surface of the transfer roller and into its pores. As the transfer roller 5 contacts the photoconductive drum 1 in a contact area establishing a nip, the toner remaining on the transfer roller tends to accumulate on the backside of the sheet, undesirably producing a darkened region. It has been proposed to clean the surface of transfer roller 5 using a cleaning blade; however, this has not proved to be practical because the blade has a tendency to push the toner on the surface of the roller into the roller pores, rather than remove the toner completely.

In order to clean the transfer roller 5 more effectively, it has been proposed to apply a bias voltage to the transfer roller of appropriate polarity and magnitude so as to electrostatically repel residual toner from the transfer roller 5 to the surface of the photoconductive drum 1 for subsequent removal. See, for example, U.S. Pat. No. 5,253,022, based on the realization that most toner has a negative polarity and some toner has a positive polarity, as depicted symbolically in application FIG. 11*a*. At first, a negative polarity bias is applied to the transfer roller 5 for a prescribed period of time, and then a positive bias is applied for a shorter time, as shown in FIG. 11*b*. Positive and negative polarity toner are expelled from the transfer roller 5 to the surface of the photoconductive drum 1, to be removed from the drum by cleaning blade 7. However, the surface of drum 5 now carries regions of positively and negatively induced electrostatic charge corresponding to the applied transfer roller bias.

FIG. 11*c* depicts removal of the residual toner from the surface of drum 1 by cleaning blade 7. The region of the drum surface 1 between cleaning blade 7 and charging roller 2 is irradiated by the pre-discharging lamp 8 to discharge negative charge on the drum surface (FIG. 11*d*). However, the pre-discharging lamp 8 has no effect on positively induced charge, which will remain on the surface of the drum 1, as shown symbolically. As the drum continues to rotate, the positive surface charge traverses the developing roller 4, picking up negative polarity toner which deposits onto the back side of the next sheet waiting for image development and fixing.

DISCLOSURE OF THE INVENTION

One advantage of the present invention is in improved cleaning of the components of an image forming apparatus so as to prevent image contamination.

Another advantage of the invention is in eliminating residual surface induced charge on the image bearing surface of an image forming apparatus.

Another advantage is in improved cleaning of the transfer and charging rollers of an image forming apparatus so as to prevent toner contamination of image bearing and formation surfaces.

A further advantage of this invention is in performing the above-recited cleaning without creating image distortion as a result of mechanical vibration induced on the image bearing surface.

Additional advantages and other features of the invention will be set forth in the description which follows and in part will become apparent to those having ordinary skill in the art upon examination of the following or may be learned from practice of the invention.

In accordance with the invention, an image forming apparatus comprises a movable image bearing member, such as a photoconductive drum that is circumscribed by a means for forming a toner image on the image bearing member, an image transfer member contactable to the image bearing member for transferring the toner image to a sheet, and a charging member operable to contact the image bearing element for applying a charge thereto. Of particular significance, an image transfer member cleaning unit is operable for applying a bias of prescribed polarity to the transfer member to repel toner from the transfer member to the image bearing member, and a charging member cleaning unit that is operable to contact the charging member to remove toner therefrom. A control unit is configured to activate the transfer member cleaning unit, and upon a prescribed time thereafter, preferably after the charging member has been operated to discharge the surface of the image bearing member, to activate the charging member cleaning unit.

The image transfer member and charging member preferably are in the form of rollers; and the bias applied to the transfer member advantageously alternates in polarity to remove positive and negative polarity toner.

To avoid inducement of mechanical vibration to the image bearing surface during exposure, the transfer roller preferably is mounted to a mechanism capable of separating the transfer member from the image forming member during exposure of the image bearing member to an image to be reproduced. Alternatively, the transfer member may be separated from the image forming member in response to an exposure synchronization signal produced by the control unit.

In a method in accordance with this invention, toner contamination on the backside of a sheet is reduced by performing the following steps:

cleaning the transfer member by applying a bias of prescribed polarity and magnitude to the transfer member to repel toner from the transfer member to the image bearing member;

contacting the image bearing member with the charging member and applying a bias to the charging member to discharge the image forming element; and thereafter, placing a cleaning element into contact with the charging member for cleaning the charging member of toner.

BEST MODE FOR CARRYING OUT THE INVENTION

Figure 1:
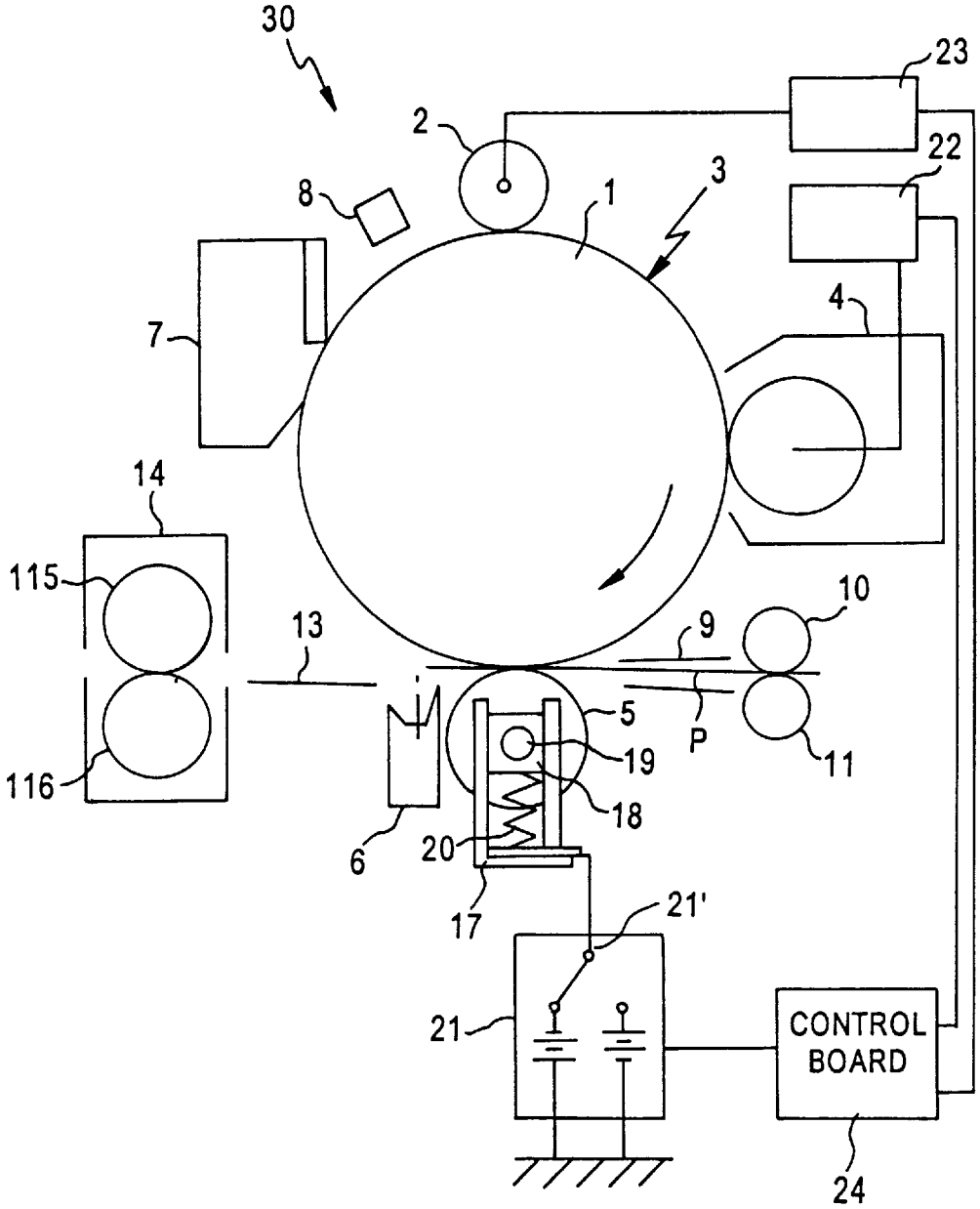
FIG. 1 is a schematic drawing of an image forming apparatus incorporating the principles of the present invention.

Referring now to the drawings, wherein like reference numerals designate identical or corresponding parts throughout the several views, and more particularly to FIG. 1 thereof, an image forming apparatus 30 embodying the present invention is shown. The image forming apparatus 30 has a rotatable photoconductive drum 1 and the following elements which may be conventional and disposed around the drum: a contact-type charging roller 2, which charges the photoconductive drum 1, an exposing device 3 which forms the latent image on the photoconductive drum 1, a developing device 4 which develops the latent image and forms a toner image on the photoconductive drum, a rotatable transfer roller 5 which rotates by accepting rotary force from the photoconductive drum and transfers the toner image to a sheet of paper P, a paper feeding device 9, 10, 11, a paper separating device 6 including an electrode which separates the sheet of paper P after the toner operation is performed. The paper P carrying the reproduced image is transferred to a paper receiving tray (not shown) by guide 14 and rollers 15 and 16. A cleaning blade 7 which cleans residual toner on the photoconductive drum 1, and a pre-discharging lamp 8 which discharges electric charge on the photoconductive drum 1. The photoconductive drum 1 may have a diameter of 80 mm and the transfer roller 5 may have a diameter of approximately 16 mm to 22 mm, although other sizes can be used, each of which rotates at a speed of, for example, 120 mm per second.

The transfer roller 5 is mounted on a bracket 17 through a conductive bearing 19, and is urged into contact with the photoconductive drum by a spring 20.

Transfer roller 5 is preferably formed of a conductive Styrofoam, for example, silicone, urethane, epichlorohydrin, EPDM. The resistance of the roller is $10^8$ to $10^{11}$, and has a hardness of under 30 of the JISA standard.

The surface of the transfer roller 5 is maintained in contact with the surface of the photoconductive drum with a pressure less than 9.8N by spring 20, so that the nip width between the roller 5 and drum 1 is maintained at between 1 and 2 mm.

Sources of bias potential 21, 22 and 23 are applied to transfer roller 5, development station 4 and charging roller 2, respectively all under the control of a control unit 24. The control unit 24 comprises a CPU, ROM, RAM and peripheral and interface circuitry, configured to perform the sequence of operation of the image forming apparatus, as hereinafter described.

In operation, the surface of the photoconductive drum 1 is negatively charged to, for example, −800V by the charging roller 2. The charged surface of the drum is exposed by the exposing device 3 which includes a haloid lamp, and then an electric latent image is formed thereon. The charge surface of the drum 1 where light is not irradiated is developed into a toner image by the developing device 4 in which toner is positively or negatively charged, as the case may be; and the respective negative or positive developing bias voltage is applied. The sheet of paper P is fed from a paper tray (not illustrated) to registration rollers 10 and 11. From the registration rollers 10 and 11, the sheet of paper P is fed to the nip between drum 1 and transfer roller 5 via the pair of paper guide plates 9. The sheet of paper P is in pressurized contact between the photoconductive drum 1 by the transfer roller 5 at the nip. Since appropriate polarity bias voltage is applied from power source 21 to the transfer roller 5 by manipulation of polarity selector switch 21' the toner image on the photoconductive drum, which is positively or negatively charged, is transferred to the sheet of paper P. The sheet of paper P is discharged by the discharge electrode of the paper separating device 6 and then the sheet of paper P is separated from the photoconductive drum.

The sheet of paper P on which the toner image is formed is next transported to fixing device 14 which has a heated roller 115 and a pressure roller 116 via a guide plate 13, and the toner image is fixed on the sheet. The sheet of paper P is now discharged to a paper discharge tray (not illustrated). After the transfer operation, the residual toner on the surface of the photoconductive drum 1 is cleaned by the cleaning blade 7, and residual electric charge on the drum 1 is discharged by the discharge lamp 8.

Figure 2:
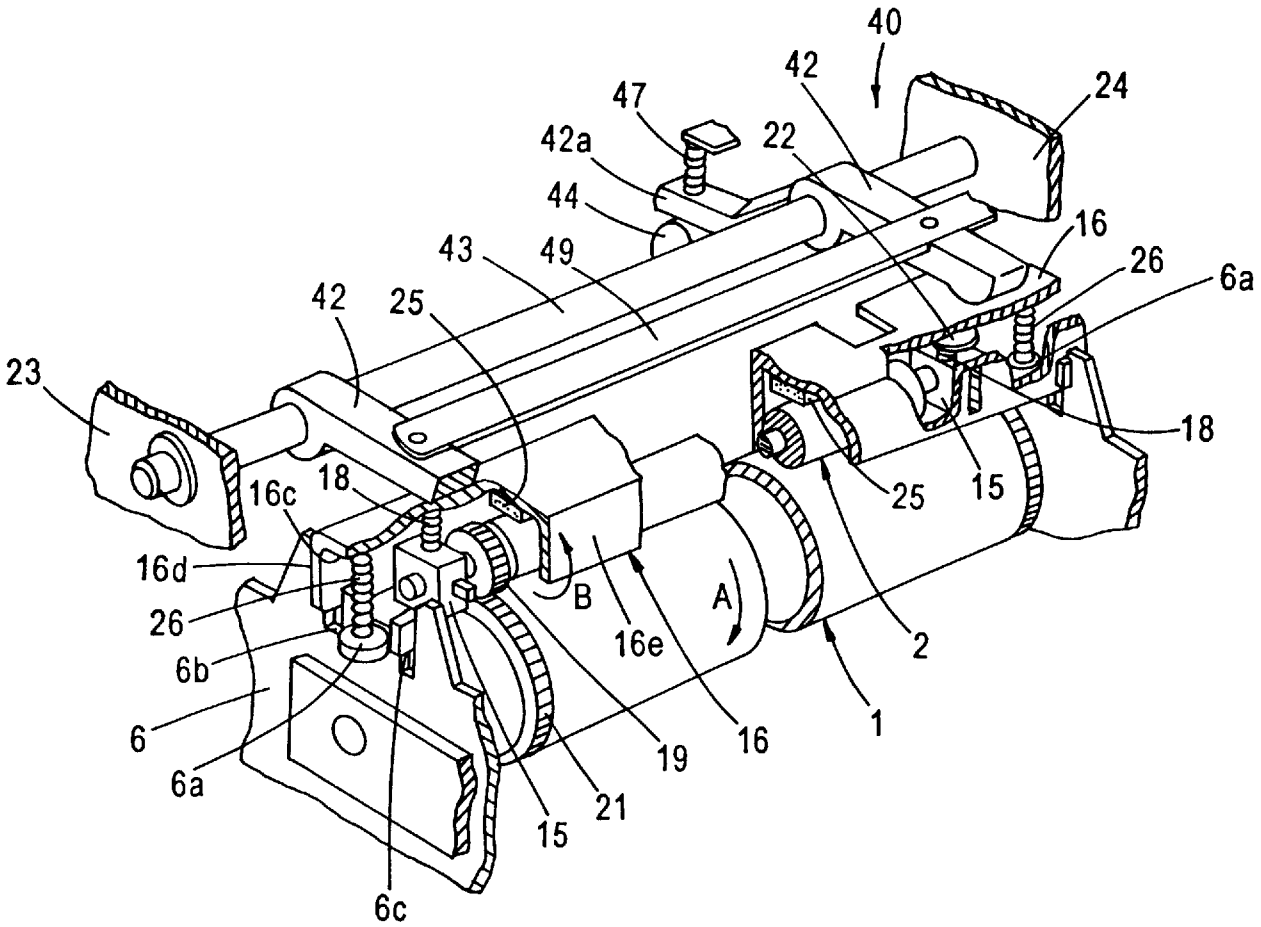
FIG. 2 is a perspective view of a portion of the image forming apparatus including charging roller and cleaning unit.

With reference to FIG. 2, depicting a portion of the image forming apparatus 30 in perspective view for ease of further description, the photoconductive drum 1, together with charging roller 2, is mounted in a bracket 16, with the charging roller supported by bearing 15. The charging roller 2 and bracket 16 are at least partially enclosed by a charging roller housing 6. When the photoconductive drum 1 rotates in direction A, charging roller 2 rotates in direction B via gears 19 and 21. Electric charge is supplied to the charging roller 2 through spring 18 and bearing 15, both of which are electrically conductive.

Figure 6:
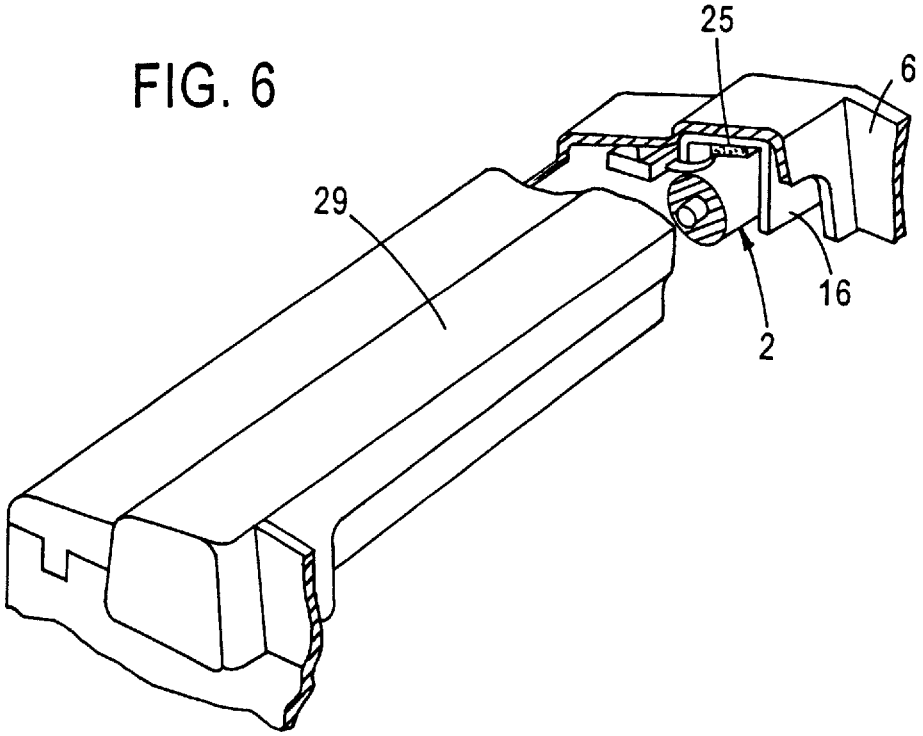
FIG. 6 is a perspective view showing the construction of the charging roller and its casing implemented in the invention.

Mounted to the inner surface of the charging roller bracket 16 is a cleaning element or sponge-like pad 25 that is selectively moved into mechanical contact with the surface of charging roller 2 for cleaning thereof, in a manner described hereinafter. Springs 26 are disposed between housing 6 and bracket 16. Referring to FIG. 6, cover plate 29 of housing 6 is a stopper for upward movement of the charging roller bracket 16. A mechanism 40 for moving the charging roller 2 selectively into contact with photoconductive drum 1, and cleaning element 25 selectively into contact with the charging roller, comprises a pair of arms 41 and 42 linked together by bar 49 and pivotably mounted on a shaft 43 in turn supported by frames 23 and 24 as shown in FIG. 2.

Figure 3:
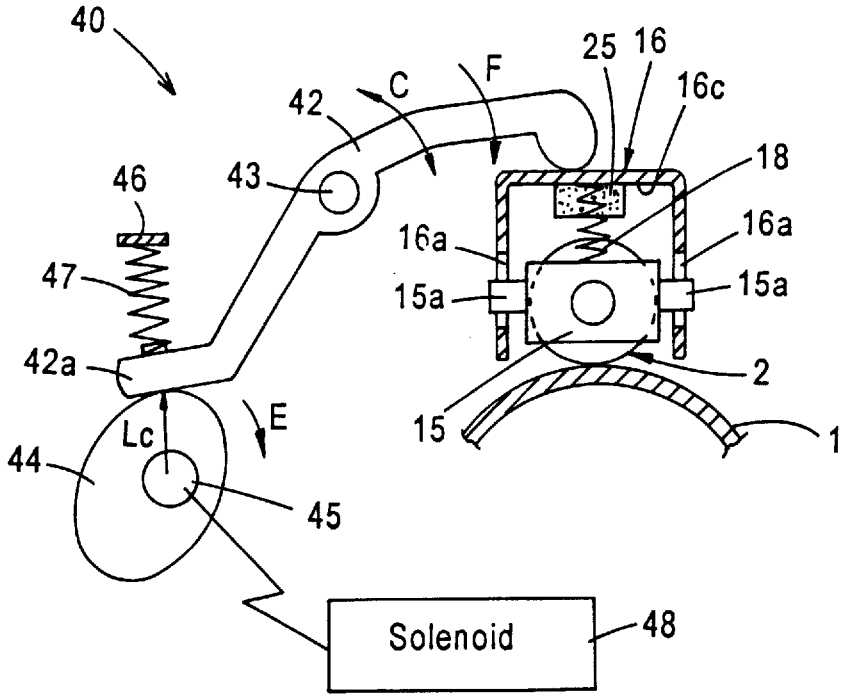
FIGS. 3–5 show a sequence for discharging the photoconductive drum surface with the contact charging roller and then mechanically cleaning the roller in accord with the invention.
Figure 4:
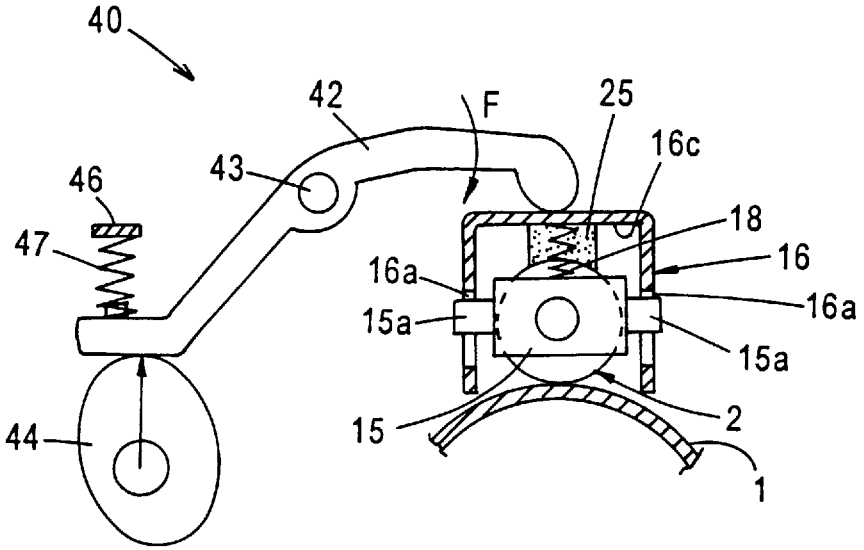
Figure 5:
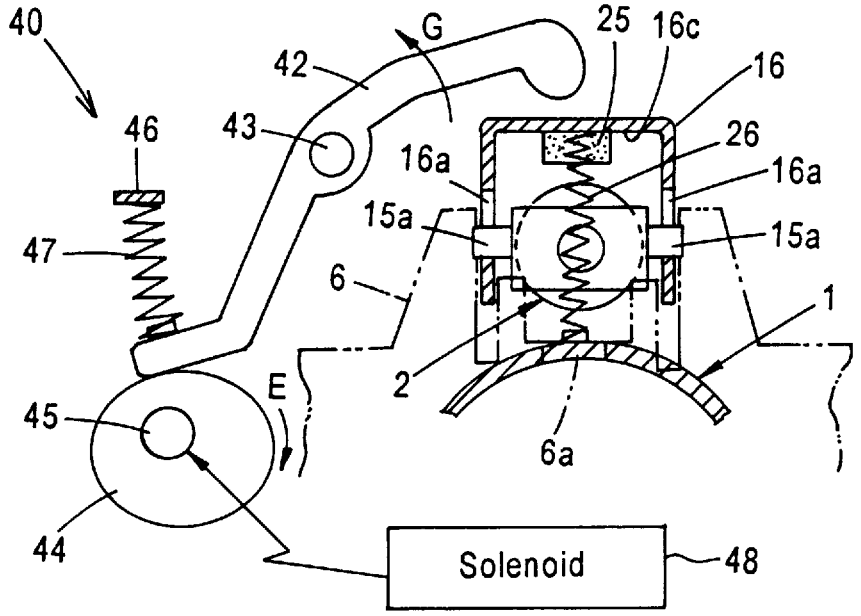

Referring to FIGS. 3–5, the arm 42 on one side of bar 49 is arcuately shaped, with one end positioned for contact with the outer surface of charging roller bracket 16, and the opposite end riding on an eccentric cam 44 that is coupled to an electric motor (not shown) through an electromagnetic clutch 48. Rotation of the arm 42 on shaft 43 varies during rotation of cam 44, tracking the cam surface. The arm 42 is biased into the position shown in FIG. 5 out of engagement with charging roller bracket 16 by spring 47 in expansion between a fixed frame member 46 and the cam contacting end of arm 42.

Bracket 16 comprises an end wall **16*c* and a pair of joining side walls that together are U-shaped in cross-section, as depicted in FIG. 5. Bearing 15 supporting roller 2 has a pair of outwardly extending projections 15*a* that ride within a pair of slots 16*a* formed in opposite walls of the bracket 16. The bearing 15 floats within the wall slots 16*a*, urged downwardly by spring 18. In the quiescent state shown in FIG. 5, the charging roller 2 is out of contact both with pad 25 and the surface of photoconductive drum 1**.

Each time the electromagnetic clutch 48 is operated, cam 44 is caused to rotate 120° into three successive positions shown respectively in FIGS. 3–5.

In the first position (FIG. 3), cam 44 is oriented such that arm 42 is pivoted into contact with charging roller bracket 16 so as to urge the charging roller against photoconductive drum 1 by the force of spring 18. The bracket 16 itself is maintained out of contact with the photoconductive drum by spring 26 on housing portion **6*a*. Hence, in the first position, the charging roller 2 contacts photoconductive drum 1, whereas cleaning pad 25** is separated from the surface of the charging roller.

Upon activation of the electromagnetic clutch 48, the cam 44 rotates clockwise by 120° into the position shown in FIG. 4. Arm 42 rotates clockwise, driving the charging roller bracket 16 downward until pad 25 contacts the surface of the charging roller.

With the electromagnetic clutch activated a third time, the cam 44 rotates clockwise by 120° again, into the position shown in FIG. 5. Riding on the surface of cam 44, the arm 42 now rotates counterclockwise, separating from bracket 16. Roller 2 becomes now separates both from the photoconductive drum 1 and cleaning pad 25, by the action of springs 18 and 26.

Of particular significance to this invention, cleaning of the transfer roller 5 and charging roller 2 is arranged and synchronized such that the transfer and charging rollers are automatically cleaned, and the surface of photoconductive drum 1 discharged. This will prevent residual toner from traversing the charging roller 2 and depositing on the backside of the next sheet to be fed to the image forming apparatus. As was described previously in conjunction with FIGS. **11*a*–11*d*, residual charge on the surface of photoconductive drum 1, despite discharging by pre-discharging lamp 8, will travel to developing roller 4 where toner is picked up and disadvantageously deposited on the sheet. This invention alleviates that problem by first operating the charging roller 2 to discharge induced charge on the surface of the drum 1, and only then cleaning the surface of the charging roller itself by mechanical contact with pad 25**.

Figure 7:
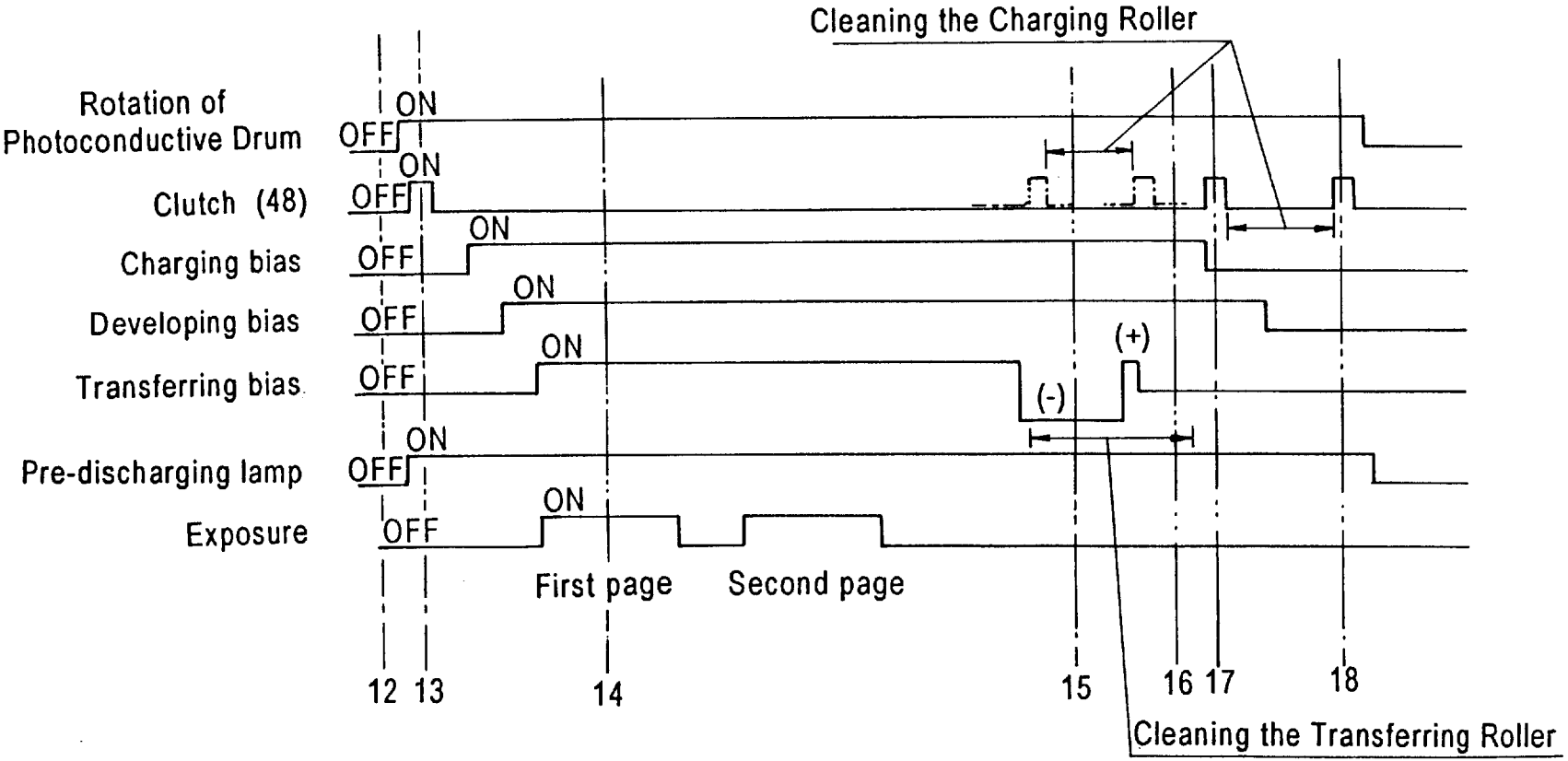
FIG. 7 is a timing diagram showing the sequence of operation of image forming apparatus components in accordance with the invention.

FIG. 7 shows the operation of an image forming apparatus in accordance with the principles of this invention. The diagram shows the sequence of photoconductive drum rotation, electromagnetic clutch activation, the operations of the charging roller, developing station and transfer roller by application of respective bias thereto, operation of pre-discharging lamp 8 and control of exposure. The sequence of operation of components is controlled by control unit 24, suitably programmed in a manner known to those skilled in the art.

Figure 12:
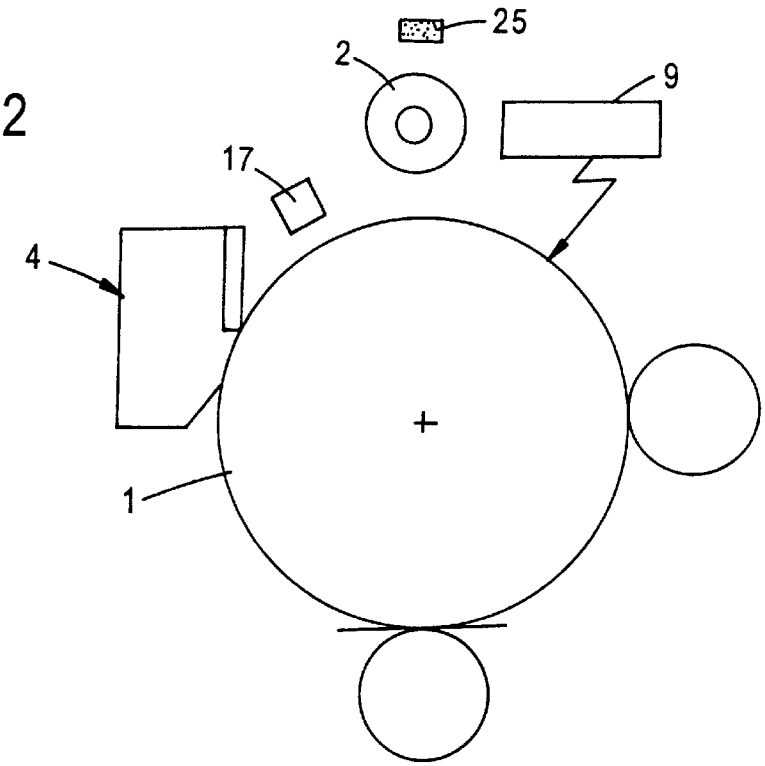
FIGS. 12–18 depict the sequence of operation of elements for cleaning transfer and charging rollers, in accordance with the invention.

At time 12, which corresponds to the state of image forming apparatus depicted in FIG. 12, the charging roller 2 initially does not contact the surface of the photoconductive drum 1. At this time, the charging roller positioning mechanism 40 is in the state shown in FIG. 5.

Figure 13:
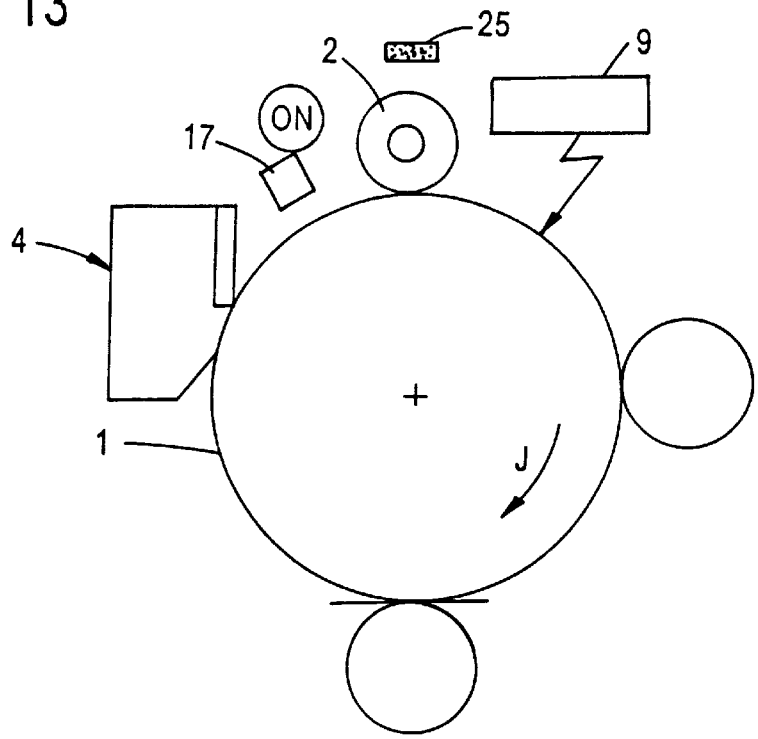

At time 13, the photoconductive drum rotates. The electromagnetic clutch is activated, causing cam 44 to rotate into the position shown in FIG. 3. The charging roller 2 now is in -contact with the photoconductive drum 1, and pre-discharging lamp 17 is on, as shown schematically in FIG. 13.

Figure 14:
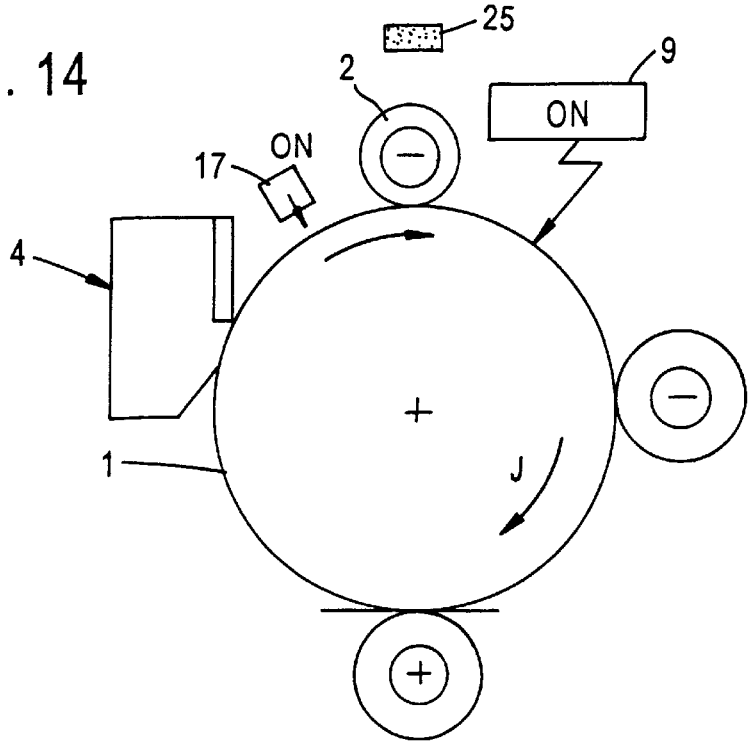

At time 14, the developing bias is on, transferring bias is on, the pre-discharging lamp 17 is on and exposure is taking place, as shown in FIG. 14. The charging roller 2 is in contact with and charging the surface of the photoconductive drum 1.

Figure 15:
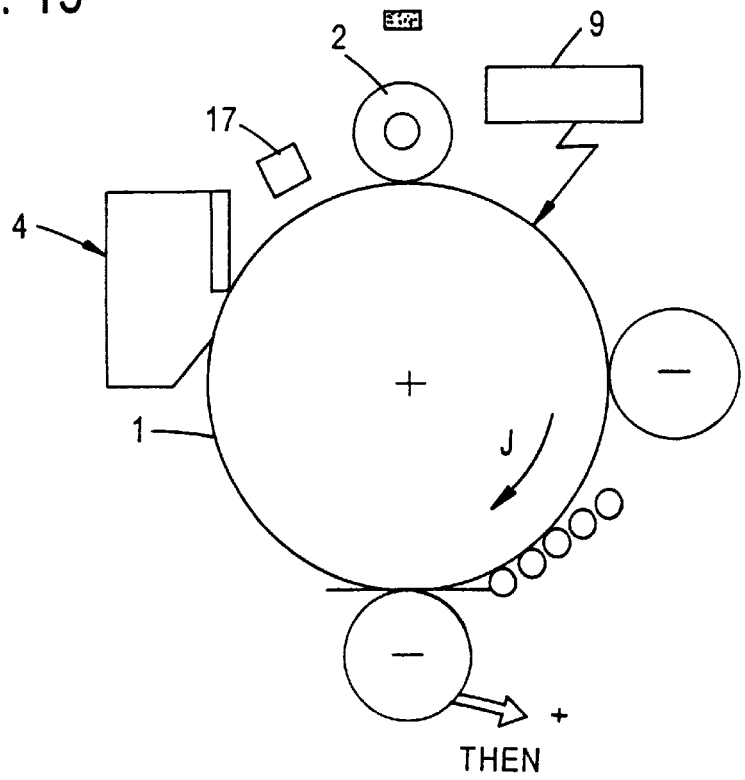

At time 15 (see FIG. 15), most of the remaining toner on the drum upstream of transfer roller 5 is of negative polarity, whereas a lesser amount of toner is of positive polarity. A first negative polarity bias is applied to the transfer roller 5 for a relatively long time, such as for several rotations of the drum, and then a positive polarity bias is applied to the transfer roller for a shorter time in the manner described in U.S. Pat. No. 5,253,022 incorporated herein by reference. Consequently, both negative and positive polarity toner are expelled from the surface of the transfer roller, and its pores, to the photoconductive drum 1.

Figure 16:
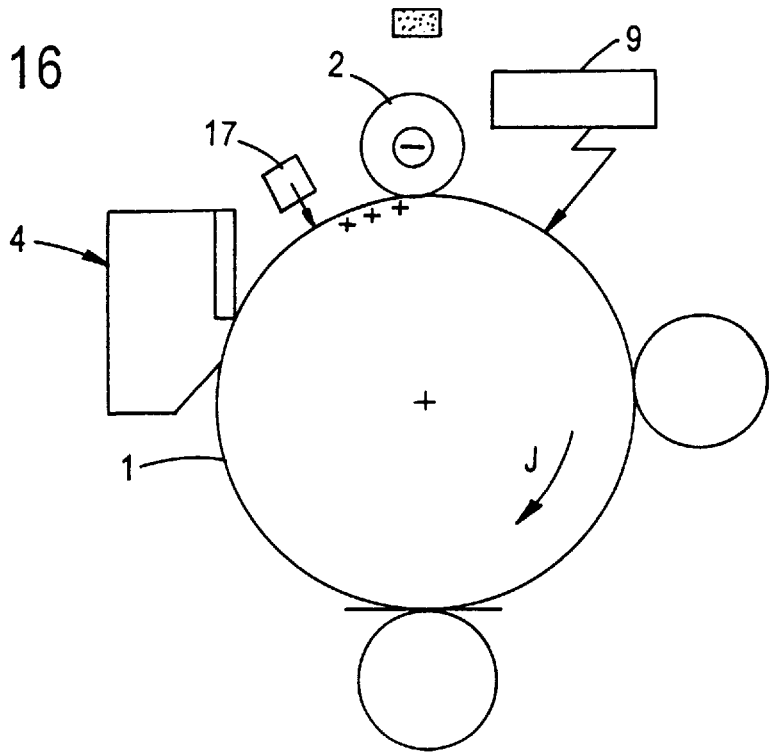
Figure 17:
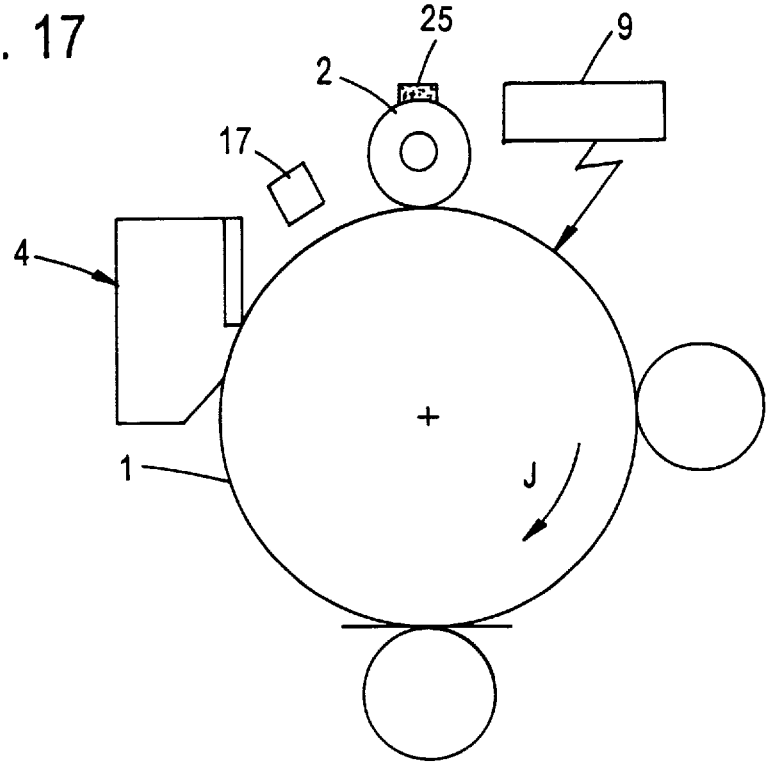

At time 16, with charging roller 2 in continuing contact with the surface of photoconductive drum 1, and a negative bias applied, the induced positive charge remaining on the photoconductive drum is discharged (FIG. 16).

At time 17, the electromagnetic clutch 48 is again activated to cause the charging roller bracket 16 to obtain the position shown in FIG. 4, with pad 25 in contact with the surface of roller 2. The charging roller 2 continues to maintain contact with and rotate with the photoconductive drum 1. As the roller 2 now rotates, the pad 25 cleans the surface of roller 2.

Hence, the contact charging roller 2 is surface cleaned after the roller has discharged the residual positive charge on the surface of the photoconductive drum. In other words, the process of mechanically cleaning the charging roller 2 is carried out only after the transfer roller 5 has been electrically cleaned and the residual charge on the photoconductive drum has been discharged by roller 2.

Figure 18:
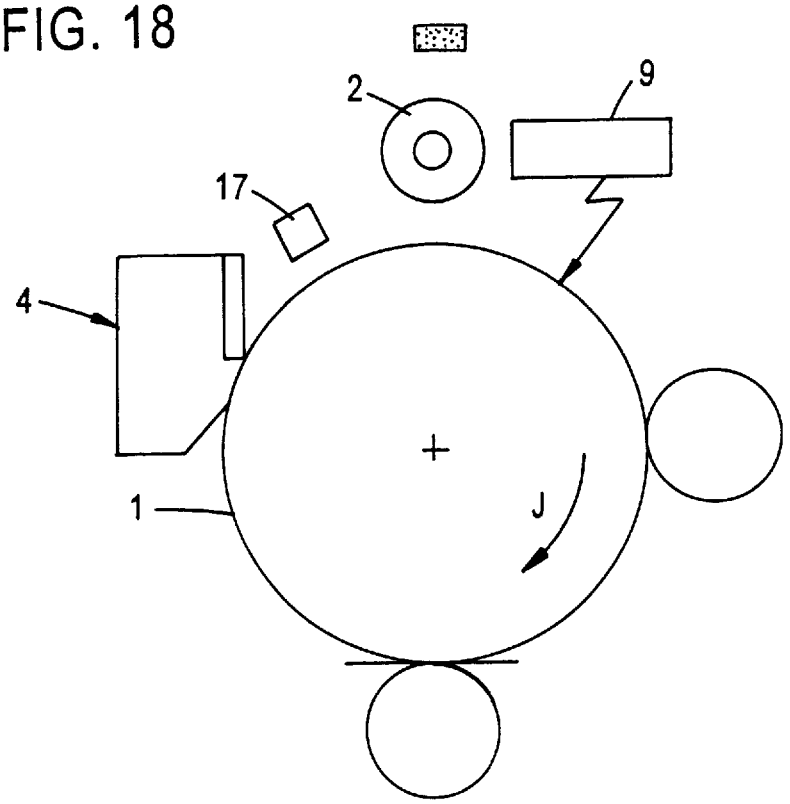

At time 18, the electromagnetic clutch is once again activated, causing the cam 44 to rotate into the position shown in FIG. 5, now releasing the charging roller bracket 16 and enabling the roller 2, drum 1 and pad 25 to separate from each other, as shown in FIG. 18.

If the charging roller 2 had been separated form the photoconductive drum 1 with a hypothetical timing shown in chain-line in FIG. 7, the charging roller 2 would have been separated from the surface of the photoconductive drum 1 prematurely, and some of the residual positive charge on the photoconductive drum would not have been discharged by the charging roller 2.

Figure 8:
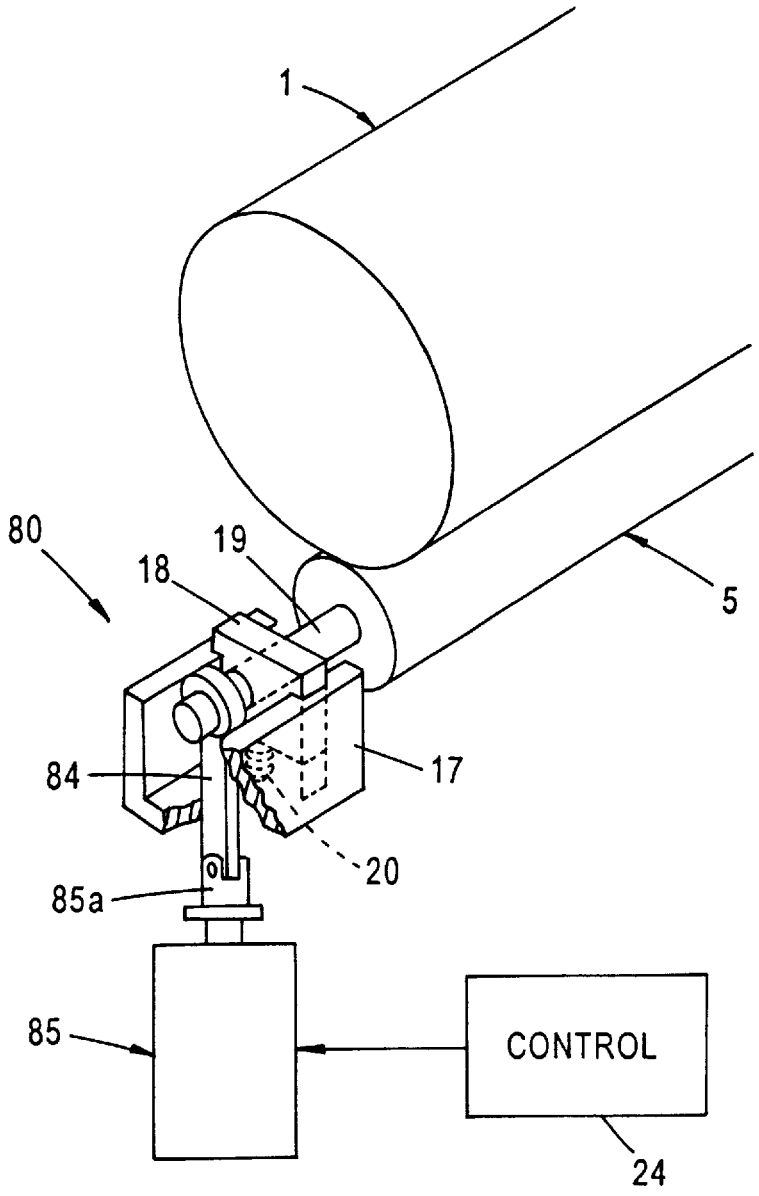
FIG. 8 depicts a mechanism for separating the transfer roller from the surface of the photoconductive drum in response to a prescribed condition.
Figure 9:
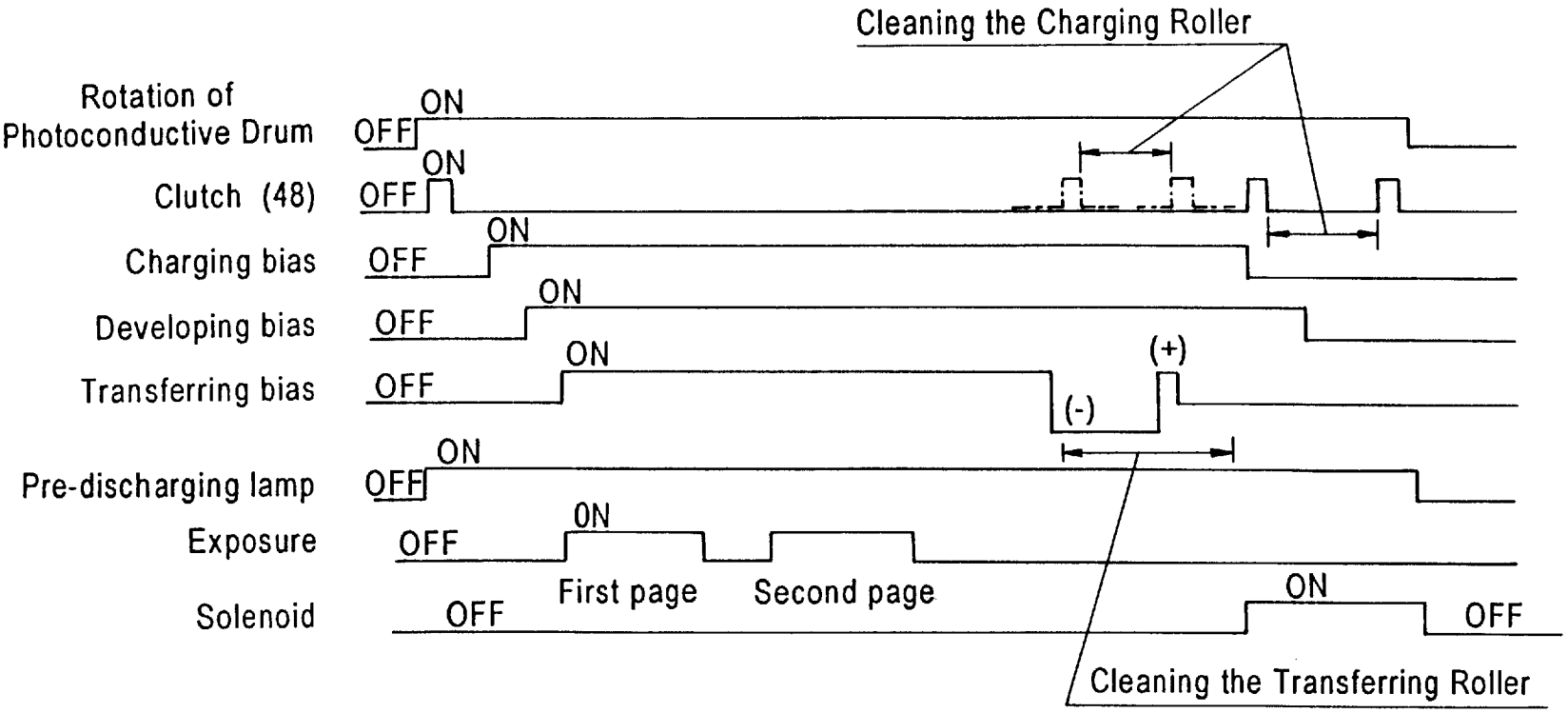
FIG. 9 is a timing diagram showing control of separation of the transfer roller from the surface of the photoconductive drum.

In the embodiment shown in FIG. 7, the transfer roller 5 is maintained continuously in contact with the surface of photoconductive drum 1. However, preferably, and in accordance with another aspect of this invention, the transfer roller 5 is separated from the photoconductive drum 1 after the transfer roller has been electrostatically cleaned, to avoid transferring mechanical vibration from the transfer roller to the photoconductive drum during image exposure. Referring to FIG. 8, the shaft 19 of transfer roller 5 is controlled by a transfer roller moving mechanism 80 comprising a bearing 18 receiving the roller shaft, and support block 82 having sidewall grooves receiving the bearing 81 such that the bearing and roller 5 can be moved vertically for contact with or separation from the photoconductive drum 1. Spring 20 between the bearing 18 and block 17 maintains the transfer roller 5 normally in contact with the photoconductive drum 1. Solenoid 85 has an armature 85*a* coupled to roller shaft 19 through a link 84. When the solenoid 85 is energized, the roller shaft is pulled downward, against the force of spring 20 in FIG. 8, and the transfer roller 5 is separated from the photoconductive drum 1.

Figure 10:
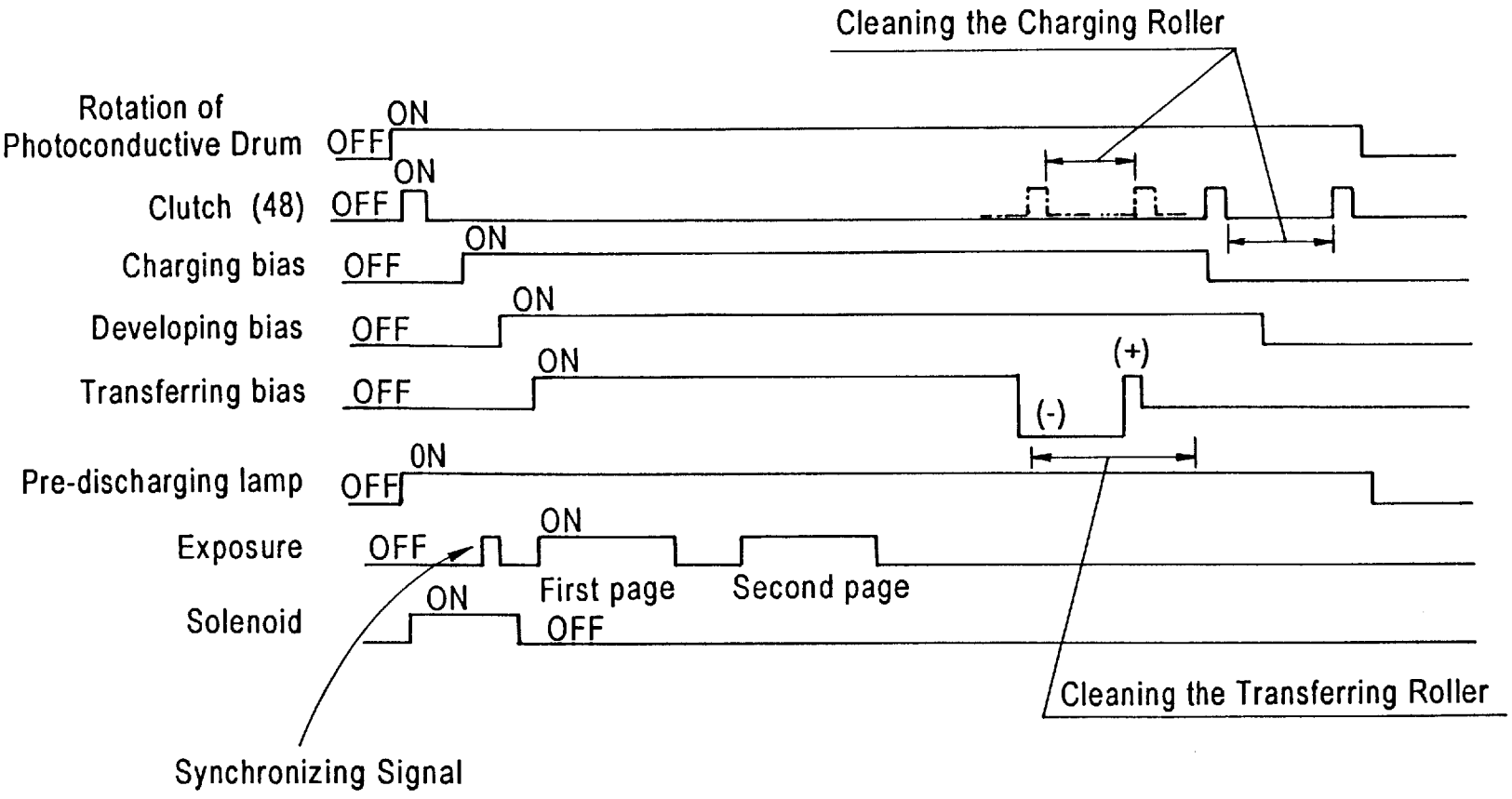
FIG. 10 is a timing diagram showing separation of the transfer roller from the photoconductive drum during generation of an image exposure synchronization signal.
Figure 11A:
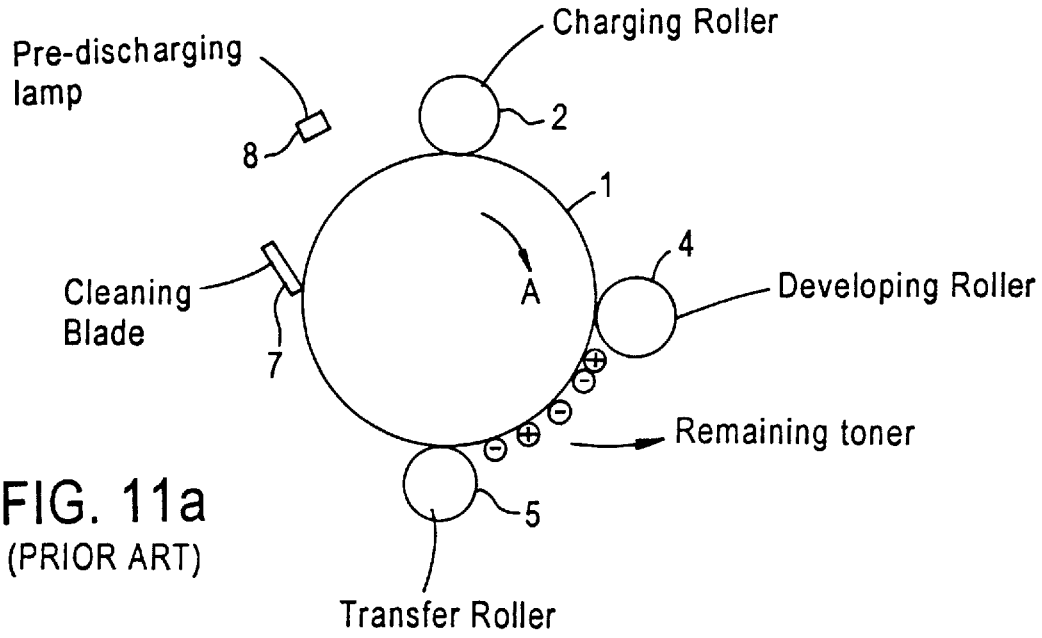
FIG. 11a (PRIOR ART)
FIGS. 11*a*–11*d*, depict an operating sequence known in the prior art for cleaning the rollers and drum.
Figure 11B:
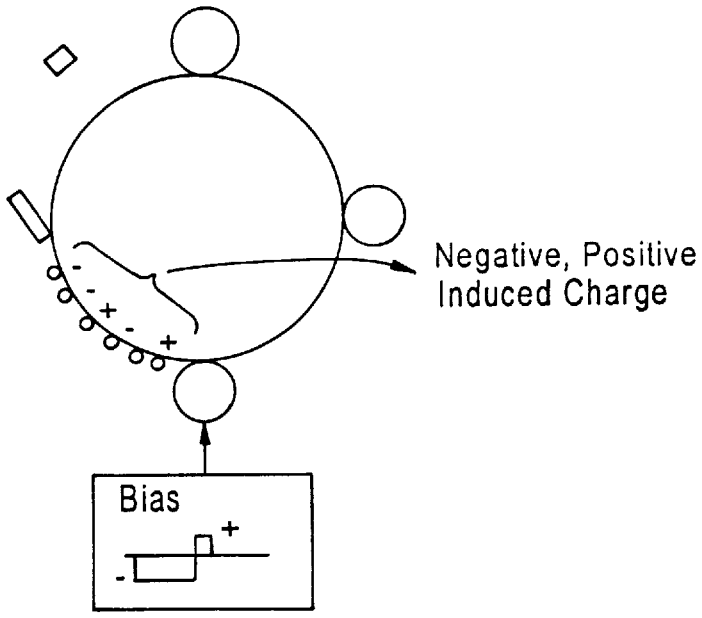
FIG. 11b (PRIOR ART)
Figure 11C:
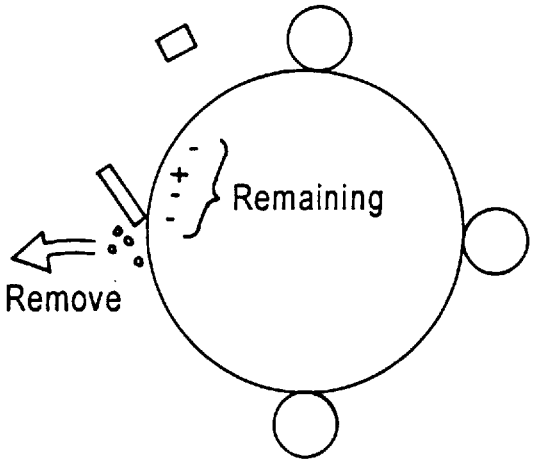
FIG. 11c (PRIOR ART)
Figure 11D:
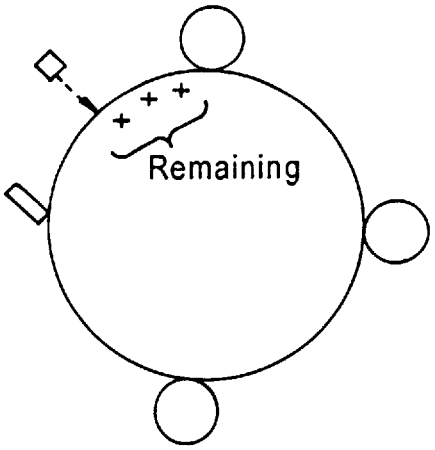
FIG. 11d (PRIOR ART)

FIG. 10 shows another example of timing for separation of the transfer belt roller 5 from the photoconductive drum for reducing mechanical vibration on the drum during exposure. In this example, an exposure synchronization signal is produced by control unit 24, representing the beginning of a series of exposure cycles in a known manner. When the photoconductive drum 1 begins to rotate, solenoid 85 is turned on, and the transfer roller 5 is separated from drum 1. After the synchronizing signal recorded on the drum 1 has passed at the transfer roller, and before the exposure cycle begins to expose surface of the drum 1, the solenoid is turned off, and the transfer roller is placed back into contact with drum. Since the transfer roller is not in contact with the photoconductive drum while an electrostatic latent image is formed, distortion of the image by contact vibration between the transfer roller 5 and photoconductive drum 1 does not occur.

There accordingly has been described a novel system and methodology for preventing contamination of the backside of a sheet by toner in an image forming apparatus. The transfer roller 5 first is electrostatically cleaned, and toner expelled to the surface of the photoconductive drum is cleaned by blade 7. Induced negative charge on the drum is neutralized by a pre-discharging lamp 8 and then residual negative induced charge is discharged by charging roller 2. Only thereafter is the charging roller 2 mechanically cleaned by pad 25. Preferably, the transfer roller 5 is separated from the photoconductive drum during sensitive periods of image formation, to avoid transferring mechanical vibration from roller 5 to the drum.

While the invention has been described with reference to the structures disclosed herein, it is not confined to the details set forth and this application is intended to cover such modifications or changes as may come within the purposes of the improvements or the scope of the following claims.

I claim:

1. An image forming apparatus, comprising:

a movable image bearing member;

means for forming a toner image on said image bearing member;

an image transfer member contactable to said image bearing member for transferring said toner image to a sheet;

a charging member operable to contact said image bearing member for applying a charge thereto;

an image transfer member cleaning unit operable for applying a bias of prescribed polarity to said image transfer member, while said charging member applies said charge to said image bearing member, to repel toner from said image transfer member to said image bearing member;

a charging member cleaning unit operable to contact said charging member to remove toner therefrom; and a control unit configured to activate said image transfer member cleaning unit and upon a prescribed time thereafter to activate said charging member cleaning unit.

2. An apparatus as in claim 1, including means for exposing a surface of said image bearing member charged by said charging member to an image for forming a latent image on said image bearing member.

3. An apparatus as in claim 2, including a developing member contacting said image bearing member for supplying a toner thereto and converting said latent image into a toner image.

4. An apparatus as in claim 3, including a cleaning blade in contact with said image bearing member for removing toner material transferred from said image transfer member to said image bearing member.

5. An apparatus as in claim 4, including a pre-discharging lamp for discharging a surface potential induced on said image bearing member by a toner.

6. An apparatus as in claim 1, wherein said prescribed time of said control unit is selected to correspond to movement of said image bearing member.

7. An apparatus as in claim 6, wherein said control unit is further configured to activate said charging member during movement of said image bearing member, and said prescribed time is selected such that charge induced on the surface of said image bearing member is neutralized by said charge inducing member prior to activation of said charging member cleaning unit.

8. An apparatus as in claim 1, wherein said image transfer member cleaning unit is operable during cleaning for applying to said image transfer member a bias of one polarity and an opposite polarity in succession.

9. An apparatus as in claim 1, wherein said charging member cleaning unit comprises a pad capable of removing toner from said charging member, and a movable support bracket positioning said pad selectively into contact with said charging member.

10. An apparatus as in claim 1, including a bracket supporting said charging member and said charging member cleaning unit, and a drive mechanism for moving said bracket so as to place said charging member selectively into contact with said image bearing member and to place said charging member cleaning unit selectively into contact with said charging member.

11. An apparatus as in claim 10, wherein said drive mechanism comprises a motor rotating a cam surface, and a lever contacting said bracket and said cam surface such that movement of said motor pivots said lever in accordance with the shape of said cam surface.

12. An apparatus as in claim 11, wherein said drive mechanism further includes a clutch mechanism coupling said motor and cam, and said cam is moved successively into a plurality of discrete positions in response to momentary activations of said clutch mechanism.

13. An apparatus as in claim 1, wherein said image transfer member is mounted to a solenoid so as to be placed selectively into contact with said image bearing member, and said control unit is further configured to control said solenoid to separate said image transfer member from said image bearing member in response to a prescribed condition.

14. The apparatus as in claim 13, wherein said solenoid is activated to separate said image transfer member from said image bearing member following cleaning of said image transfer member by said image transfer member cleaning unit.

15. The apparatus as in claim 13, wherein said solenoid is activated to separate said image transfer member from said image bearing member during receipt of said control unit of a synchronization signal.

16. The apparatus as in claim 15, wherein said synchronization signal is embedded in an exposure signal recorded in said image bearing member.

17. An electrostatic image forming apparatus, comprising:

a photoconductive drum upon which an electrostatic latent image is to be formed;

a toner dispenser for transferring a toner to said photoconductive drum;

an electric charge inducing roller for applying an electric charge to said photoconductive drum;

a charge inducing roller support member for positioning said charge inducing roller selectively into contact with said photoconductive drum;

means for advancing a sheet to said photoconductive drum;

an image transfer roller for transferring a toner image corresponding to said latent image from said photoconductive drum to said sheet;

a charge inducing roller cleaning unit mounted for selective contact with a surface of said electric charge inducing roller;

a transfer roller cleaning unit comprising a source of bias to be applied to said image transfer roller while said electric charge inducing roller applies said charge to said photoconductive drum, said bias being of a polarity selected to repel toner material from said image transfer roller; and a control unit configured to activate said transfer roller cleaning unit and upon a prescribed time thereafter to activate said charge inducing roller cleaning unit.

18. An apparatus as in claim 17, wherein said prescribed time of said control unit is selected to correspond to rotation of said photoconductive drum.

19. An apparatus as in claim 17, wherein said control unit is further configured to activate said charging roller during movement of said photoconductive drum, and wherein said prescribed time is selected such that charge induced on the surface of said photoconductive drum is neutralized by said electric charge inducing roller prior to activation of said charge inducing roller cleaning unit.

20. An apparatus as in claim 17, wherein during cleaning said transfer roller cleaning unit is operable for applying to said image transfer roller a bias of one polarity and the opposite polarity in succession.

21. An apparatus as in claim 17, wherein said charge inducing roller cleaning unit comprises a pad of material capable of removing toner from said electric charge inducing roller, and a movable support bracket positioning said pad selectively into contact with said electric charge inducing roller.

22. An apparatus as in claim 17, including a bracket supporting said electric charge inducing roller and said charge inducing roller cleaning unit, and a drive mechanism for moving said bracket so as to place said electric charge inducing roller selectively into contact with said photoconductive drum and to place said charge inducing roller cleaning unit selectively into contact with said electric charge inducing roller.

23. An apparatus as in claim 22, wherein said drive mechanism comprises a motor rotating a cam surface, and a lever contacting said bracket and said cam surface such that movement of said motor pivots said lever in accordance with the shape of said cam surface.

24. An apparatus as in claim 23, wherein said drive mechanism further includes a clutch mechanism coupling said motor and cam, and said cam is moved successively into plurality of discrete positions in response to momentary activations of said clutch mechanism.

25. An apparatus as in claim 17, wherein said image transfer roller is mounted to a solenoid so as to be placed selectively into contact with said photoconductive drum, and said control unit is further configured to control said solenoid to separate said image transfer roller from said photoconductive drum in response to a prescribed condition.

26. The apparatus as in claim 25, wherein said solenoid is activated to separate said image transfer roller from said photoconductive drum following cleaning of said image transfer roller by said transfer roller cleaning unit.

27. The apparatus as in claim 25, wherein said solenoid is activated to separate said image transfer roller from said photoconductive drum during exposure of said photoconductive drum.

28. The apparatus as in claim 27, wherein activation of said solenoid is in response to a synchronization signal recorded on said photoconductive drum.

29. In an image forming apparatus, comprising a movable image bearing member, means for forming a toner image on said image bearing member, an image transfer member operable to selectively move in and out of contact with said image bearing member for transferring said toner image to a side of a sheet, and a charging member operable to selectively move in and out of contact with said image bearing member for applying a charge thereto, a method of reducing toner contamination on the backside of the sheet, comprising the steps of:

contacting said image bearing member with said charging member and applying a bias to said charging member;

cleaning said image transfer member by applying a bias of prescribed polarity and magnitude to said image transfer member to repel toner from said image transfer member to said image bearing member and thereafter, placing a cleaning element into contact with said charging member for cleaning said charging member of toner.

30. The method of claim 29, including the step of separating said image transfer member from said image bearing member following cleaning of said image transfer member.

31. The method of claim 29, including the step of separating said image transfer member from said image bearing member during an exposure of said image bearing element.

32. The method of claim 31, wherein said image transfer member is separated from said image bearing member in response to an exposure synchronization signal.

33. The method of claim 29, wherein said image transfer member cleaning step comprises applying to said image transfer member a bias of alternating polarity.

34. An image forming apparatus, comprising:

a movable image bearing member;

a charger for applying a charge to said image bearing member;

means for forming a toner image on said image bearing member;

an image transfer member contactable to said image bearing member for transferring said toner image to a sheet;

an image transfer member cleaning unit operable for applying to said image transfer member a bias having a polarity opposite to that of said charge applied by said charger to repel toner from said image transfer member to said image bearing member; and a control unit configured to activate said charger to apply the charge onto said image bearing member while the bias is applied by said image transfer member cleaning unit.

* * * * *